US006522305B2

(12) United States Patent
Sharman

(10) Patent No.: US 6,522,305 B2
(45) Date of Patent: Feb. 18, 2003

(54) MICROWAVE ANTENNAS

(75) Inventor: David Seymour Sharman, Frankfort, IL (US)

(73) Assignee: Andrew Corporation, Orland Park, IL (US)

( * ) Notice: Subject to any disclaimer, the term of this patent is extended or adjusted under 35 U.S.C. 154(b) by 0 days.

(21) Appl. No.: 09/780,789

(22) Filed: Feb. 9, 2001

(65) Prior Publication Data

US 2002/0008670 A1 Jan. 24, 2002

Related U.S. Application Data

(60) Provisional application No. 60/185,050, filed on Feb. 25, 2000.

(51) Int. Cl.[7] ..... H01Q 19/19

(52) U.S. Cl. ..... 343/781 CA; 343/781 P; 343/772

(58) Field of Search ..... 343/771, 772, 343/781 R, 781 P, 78 CA, 839, 840, 841, 785, 786, 782

(56) References Cited

U.S. PATENT DOCUMENTS

| | | | | |
|---|---|---|---|---|
| 2,482,158 A | | 9/1949 | Cutler | 343/781 P |
| 2,605,416 A | * | 7/1952 | Foster | 343/781 P |
| 2,687,475 A | | 8/1954 | Scheldorf | 343/843 |
| 2,754,514 A | | 7/1956 | Scheldorf | 343/769 |
| 2,757,370 A | | 7/1956 | Scheldorf | 343/896 |
| 2,828,486 A | | 3/1958 | Scheldorf | 343/781 R |

(List continued on next page.)

FOREIGN PATENT DOCUMENTS

| | | |
|---|---|---|
| DE | 35 33211 A1 | 3/1987 |
| FR | 2540297 | 3/1984 |
| GB | 973583 | 10/1964 |

OTHER PUBLICATIONS

De Haro et al; "Shaped Compact Dual Reflector Antenna for Ku–Band Satellite Pico–Terminals", 1998, pp. 832–835.

(List continued on next page.)

*Primary Examiner*—Tan Ho
(74) *Attorney, Agent, or Firm*—Jenkens & Gilchrist

(57) ABSTRACT

A dual-reflector microwave antenna includes a main reflector having a shape that is a portion of a paraboloid generated by revolution of a parabola around having a single, common axis of rotation and symmetry. A primary feed extends along the axis of the main reflector on the concave side of the main reflector, and a subreflector located beyond the end of said primary feed has an image-inverting surface configuration that has a ring focus located between the main reflector and the subreflector and extending around the axis of the main reflector. In either a single or dual-reflector antenna, the main reflector has a shield with a band of dielectric or conductive material extending around at least a portion of the inner surface of the shield for reducing the return loss of the antenna. Patterns may be improved by providing a shield of absorber material extending around the outer periphery of at least an end portion of the primary feed. In the case of a dual-reflector antenna, return loss may be reduced by providing a dielectric or electrically conductive element between the primary feed and the subreflector, and/or by providing an annulus of absorber material on the surface of the subreflector.

63 Claims, 6 Drawing Sheets

U.S. PATENT DOCUMENTS

| | | | | | |
|---|---|---|---|---|---|
| 2,898,591 | A | | 8/1959 | Krahe | 343/782 |
| 2,954,556 | A | | 9/1960 | Yang | 343/726 |
| 3,162,858 | A | | 12/1964 | Cutler | 343/753 |
| 3,178,713 | A | | 4/1965 | Yang | 343/840 |
| 3,265,743 | A | | 8/1966 | Bell | 33/560 |
| 3,864,688 | A | | 2/1975 | Hansen et al. | 343/756 |
| 3,924,205 | A | | 12/1975 | Hansen et al. | 333/21 A |
| 4,178,576 | A | | 12/1979 | Schmidt, Jr. et al. | 343/781 R |
| 4,423,422 | A | | 12/1983 | Knop et al. | 343/786 |
| 4,626,863 | A | | 12/1986 | Knop et al. | 343/781 P |
| 4,673,945 | A | | 6/1987 | Syrigos | 343/755 |
| RE32,485 | E | | 8/1987 | Yang et al. | 343/786 |
| 4,780,727 | A | | 10/1988 | Seal et al. | 343/895 |
| 4,819,007 | A | | 4/1989 | Tezcan | 343/840 |
| 4,827,277 | A | * | 5/1989 | Becker et al. | 343/781 P |
| 4,851,857 | A | | 7/1989 | Dienes | 343/771 |
| 4,907,008 | A | | 3/1990 | Dienes | 343/727 |
| 5,010,350 | A | | 4/1991 | Lipkin et al. | 343/704 |
| 5,021,797 | A | | 6/1991 | Dienes | 343/727 |
| 5,109,232 | A | | 4/1992 | Monte | 343/785 |
| 4,410,892 | A | | 10/1992 | Knop et al. | 343/786 |
| 5,291,212 | A | | 3/1994 | Cox | 343/840 |
| 5,309,164 | A | | 5/1994 | Dienes et al. | 343/700 MS |
| 5,317,328 | A | | 5/1994 | Allen | 343/786 |
| 5,339,089 | A | | 8/1994 | Dienes | 343/700 MS |
| 5,363,115 | A | | 11/1994 | Lipkin et al. | 343/872 |
| 5,486,838 | A | | 1/1996 | Dienes | 343/781 R |
| 5,506,591 | A | | 4/1996 | Dienes | 343/792 |
| 5,767,815 | A | | 6/1998 | Krebs | 343/786 |
| 5,850,056 | A | | 12/1998 | Harwath | 174/40 |
| 5,859,619 | A | | 1/1999 | Wu et al. | 343/781 CA |
| 5,870,062 | A | | 2/1999 | Cox | 343/781 R |
| 5,907,310 | A | * | 5/1999 | Seewig et al. | 343/704 |
| 5,945,951 | A | | 8/1999 | Monte et al. | 343/700 MS |
| 5,952,983 | A | | 9/1999 | Dearnley et al. | 343/817 |
| 6,011,521 | A | | 1/2000 | Knop et al. | 343/781 P |
| 6,020,859 | A | * | 2/2000 | Kildal | 343/781 CA |
| 6,107,973 | A | | 8/2000 | Knop et al. | 343/781 P |

OTHER PUBLICATIONS

Erukhimovitch et al; "Two–Reflector Antenna", IEEE Conference on A&P, 1983, pp. 205–207.

Rotman et al; "Compact Dual Frequency Reflector Antennas for EHF Mobile Satellite Communication Terminals", IEEE, 1984, pp. 771–774.

Jenn et al; "Small Efficient Axially Symmetric Dual Reflector Antennas", IEEE Transactions on Antennas and Propagation, vol. 41, No. 1, Jan. 1993, 3 pgs.

Brain; "The Design and Evaluation of a High Performance 3m Antenna for Satellite Communication", *The Marconi Review,* vol. XLI, No. 211, Fourth Quarter, 1978, pp. 218–236.

* cited by examiner

MICROWAVE ANTENNAS

CROSS-REFERENCE TO RELATED APPLICATIONS

This application claims the benefit of priority of U.S. Provisional Patent Application Ser. No. 60/185,050 filed on Feb. 25, 2000.

FIELD OF THE INVENTION

The present invention relates to microwave antennas. Certain aspects of this invention are applicable to only dual-reflector antennas, and other aspects are applicable to both single-reflector and dual-reflector antennas.

SUMMARY OF THE INVENTION

In accordance with one aspect of the present invention, a dual-reflector microwave antenna is provided with a main reflector having a shape that is a portion of a paraboloid generated by revolution of a parabola around having a single, common axis of rotation and symmetry; a primary feed extending along the axis of the main reflector on the concave side of the main reflector and having an aperture spaced away from the main reflector; and a subreflector located beyond the end of said primary feed for reflecting radiation from the main reflector into the primary feed and for reflecting radiation from the primary feed onto the main reflector, the subreflector having an image-inverting surface configuration that has a ring focus located between the main reflector and the subreflector and extending around the axis of the main reflector, the ring focus having a diameter at least as large as the diameter of the aperture of the primary feed. In a preferred embodiment, the subreflector has a shape that is a portion of an ellipsoid generated by revolution of an ellipse around the axis of the main reflector, a first focal point of the ellipse being located on the axis and a second focal point of said ellipse being offset from the axis so that revolution of the ellipse around the axis forms a focal ring extending around the axis. The patterns produced by this antenna can be improved by providing an absorber-lined shield around the periphery of the subreflector The return loss of this and other dual-reflector antennas may be reduced by providing a dielectric or electrically conductive element between the primary feed and the subreflector.

In accordance with another aspect of the invention, a reflector-type microwave antenna is provided comprising a reflector having a shape that is a portion of at least one paraboloid and having an axis of symmetry; a primary feed extending along the axis; and a shield extending around the outer periphery of the reflector and projecting from the reflector in the same direction as the energy being transmitted by the reflector from the primary feed, and a band of dielectric or conductive material extending around at least a portion of the inner surface of the shield for reducing the return loss of the antenna. To improve the patterns produced by the antenna, the shield may be lined with absorber material, preferably only on the side portions to improve the horizontal pattern without significantly increasing either the gain loss or the cost of the antenna.

In accordance with a further aspect of the invention, a reflector-type microwave antenna is provided comprising a reflector having a shape that is a portion of at least one paraboloid and having an axis of symmetry; a primary feed extending along the axis; and a shield extending around the outer periphery of the reflector and projecting from the reflector in the same direction as the energy being transmitted by the reflector from the primary feed, and a shield of absorber material extending around the outer periphery of at least an end portion of the primary feed. In a preferred embodiment of this aspect of the invention, the antenna is a dual-reflector antenna that includes a subreflector of the type described above, and the shield of absorber material has an outer diameter that is smaller than the diameter of the ring focus of the subreflector.

DETAILED DESCRIPTION OF THE ILLUSTRATED EMBODIMENTS

Figure 1:
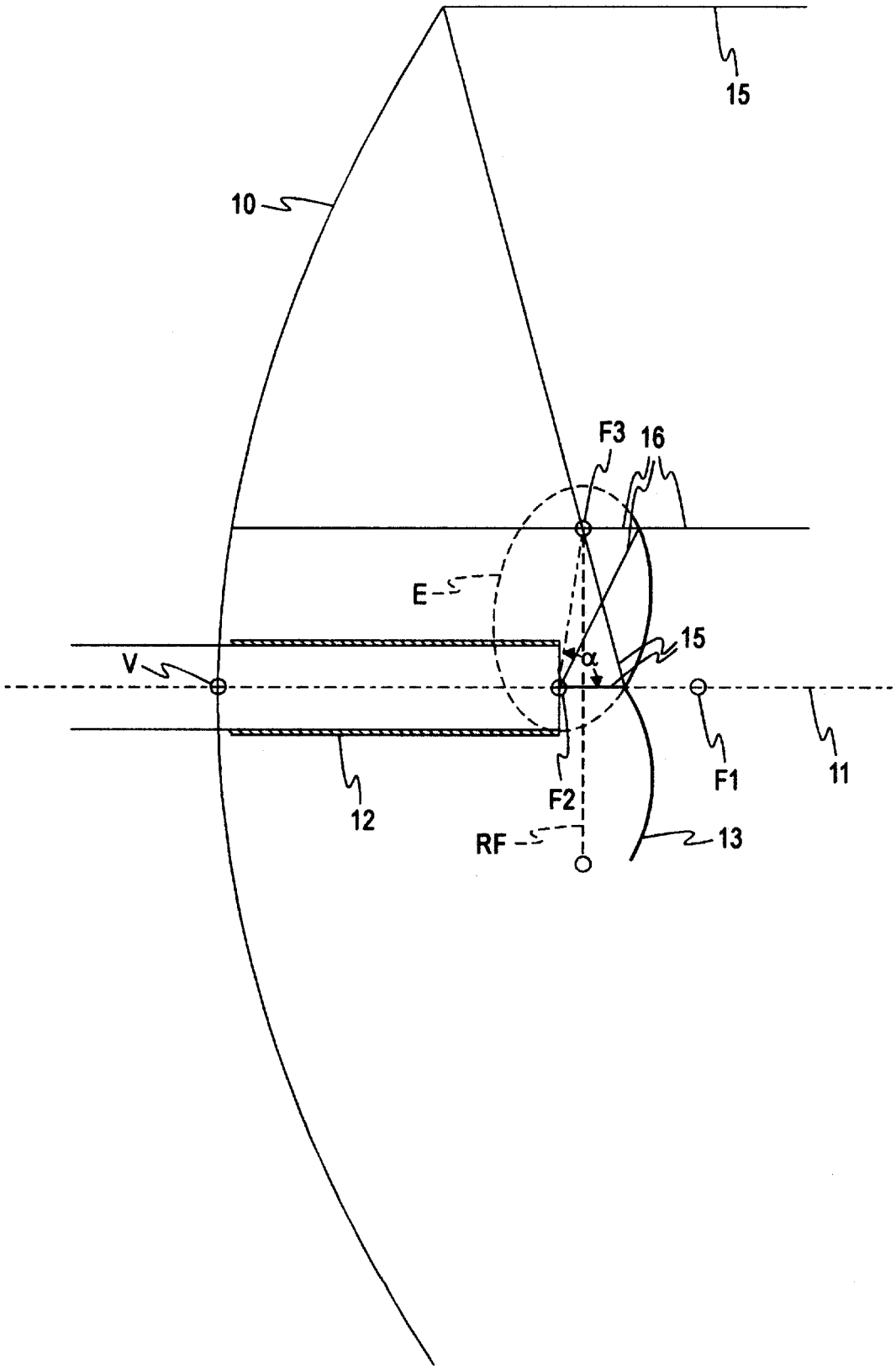
FIG. 1 is a diagrammatic illustration of a dual-reflector antenna embodying certain aspects of the present invention
Figure 3:
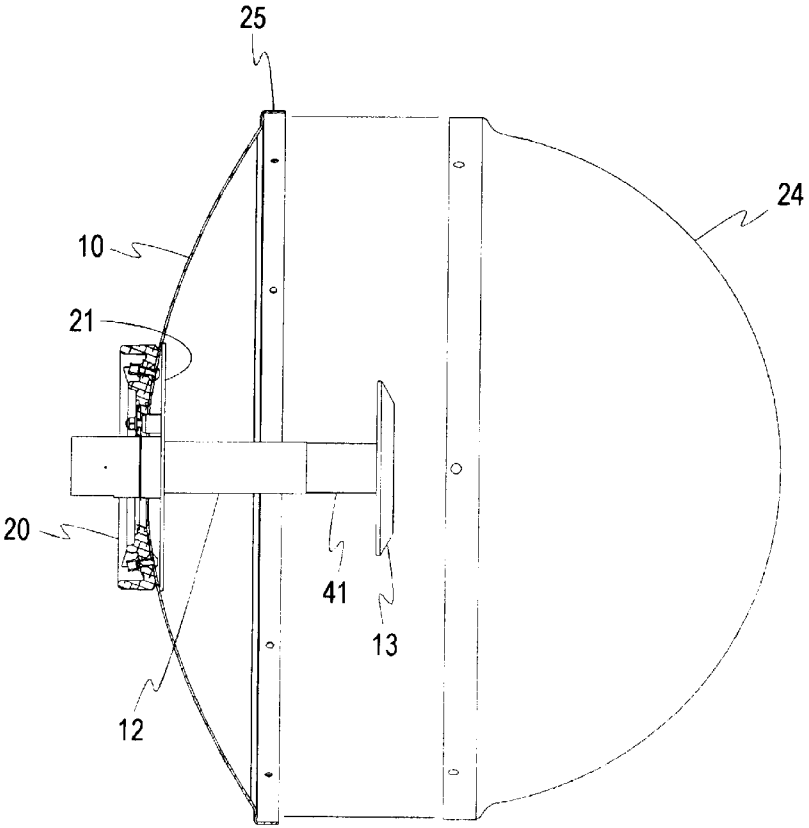
FIG. 3 is a side elevation, partially in section, of the antenna of FIG. 2.
Figure 2:
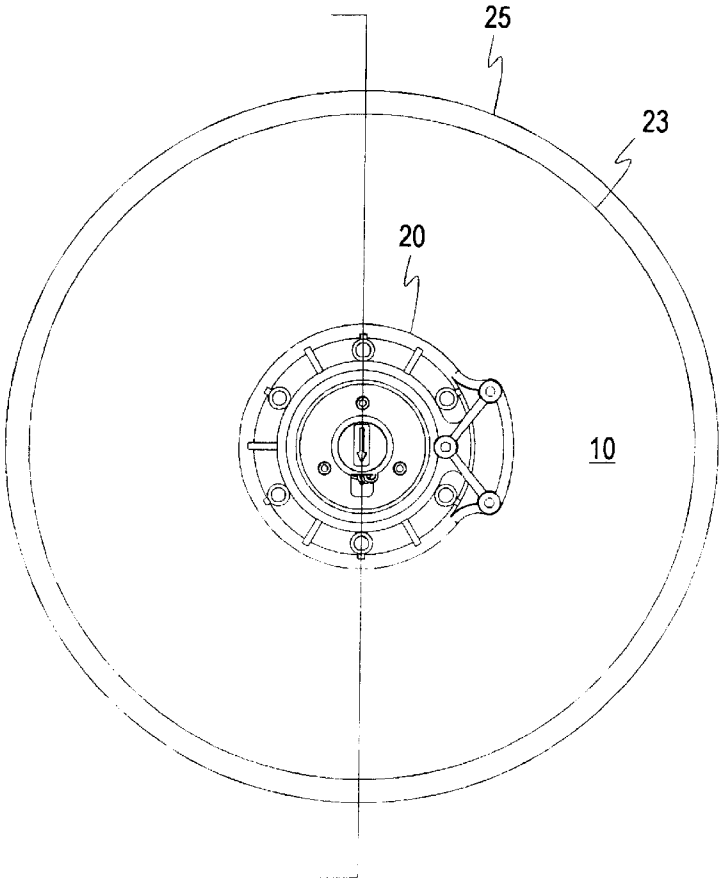
FIG. 2 is a rear elevation of a dual-reflector antenna embodying the present invention.

Turning now to the drawings and referring first to the diagrammatic illustration in FIG. 1, a main reflector 10 has a shape that is a portion of a paraboloid generated by revolution of a parabola around an axis 11, which is a single, common axis of rotation and symmetry. The main reflector 10 has a vertex V and a focus F1. Extending along the axis 11, and through the main reflector 10 and its vertex V, is a circular waveguide 12 that serves as the primary feed of the antenna. The open end of the waveguide 12 forms the aperture of the primary feed, which is spaced away from the main reflector 10. Other primary feed devices, such as various types of flared feed horns, may be used in place of the circular waveguide used in the illustrative embodiment. The outer periphery of the main reflector 10 lies in a plane that is orthogonal to the axis 11 and that extends through the circular waveguide 12, i.e., the waveguide 12 extends beyond the outer periphery of the main reflector 10 in the axial direction, on the concave side of the reflector.

Located between the end of the waveguide 12 and the focus FI of the main reflector 10 is a subreflector 13 for reflecting radiation from the main reflector into the primary feed and for reflecting radiation from the primary feed onto the main reflector. Both the main reflector 10 and the subreflector 13 are generally circular and symmetrical around the axis 11. The subreflector 13 has an image-inverting surface configuration that has a ring focus RF located between the main reflector 10 and the subreflector 13 and extending around the axis 11. The ring focus RF has a diameter at least as large as the diameter of the feed horn aperture, i.e., the open end of the circular waveguide 12. As used herein, the term "ring focus" subreflector includes subreflectors with surface configurations that reflect rays through an annular region that has a small radial width, rather than reflecting all rays through the same annular line.

That is, the ring focus may be somewhat diffused in the radial direction.

In the particular embodiment illustrated in FIG. 1, the subreflector 13 has a shape that is a portion of an ellipsoid generated by revolution of an ellipse E around the axis 11. A first focal point F2 of the ellipse is located on the axis 11, and a second focal point F3 of the ellipse is offset from the axis 11 so that revolution of the ellipse around the axis 11 forms the ring focus RF extending around the axis 11. The major axis of the ellipse E passes through the foci F2 and F3 at an angle a to the axis 11. The focus F2 of the ellipse is located at or near the phase center of the feed horn formed by the circular waveguide 12. The focal ring FR of the subreflector 13 is located between the subreflector 13 and the end of the feed horn, and, in the illustrative embodiment, the diameter of the focal ring FR is approximately the same as that of the subreflector 13.

A ray 15 from the waveguide 12 that is reflected from the center of the subreflector 13 passes through the focal ring FR onto the outermost peripheral portion of the main reflector 10, and then away from the main reflector 10 in a direction parallel to the axis 11. A ray 16 that is reflected from the outermost peripheral portion of the subreflector 13 passes through the focal ring FR to the innermost periphery of the illuminated portion of the main reflector 10, and then away from the main reflector 10 in a direction parallel to the axis 11. Thus, the wave transmitted by the antenna is the desired planar wave.

The subreflector 13 is referred to herein as an "image-inverting" subreflector because radiation from the primary feed 12 that impinges on the subreflector 13 near its center is reflected onto the outer peripheral portion of the main reflector 10 and, vice versa, radiation from the primary feed 12 that impinges on the outer portion of the subreflector 13 is reflected onto the innermost portion of the illuminated region of the main reflector 10.

FIGS. 2–6 illustrate a dual-reflector antenna utilizing the geometry depicted in FIG. 1. The main reflector 10 is mounted between a mounting hub 20 and a vertex plate 21 by multiple bolts. The circular waveguide 12 passes though the hub 20 and the vertex plate 21, on the axis 11 of the paraboloidal reflector 10, with the end 22 of the waveguide 12 located beyond the plane of the outer periphery 23 of the reflector 10. A hemispherical radome 24 made of a dielectric material telescopes over a peripheral flange 25 on the reflector 10 and is fastened thereto by multiple screws.

Figure 4:
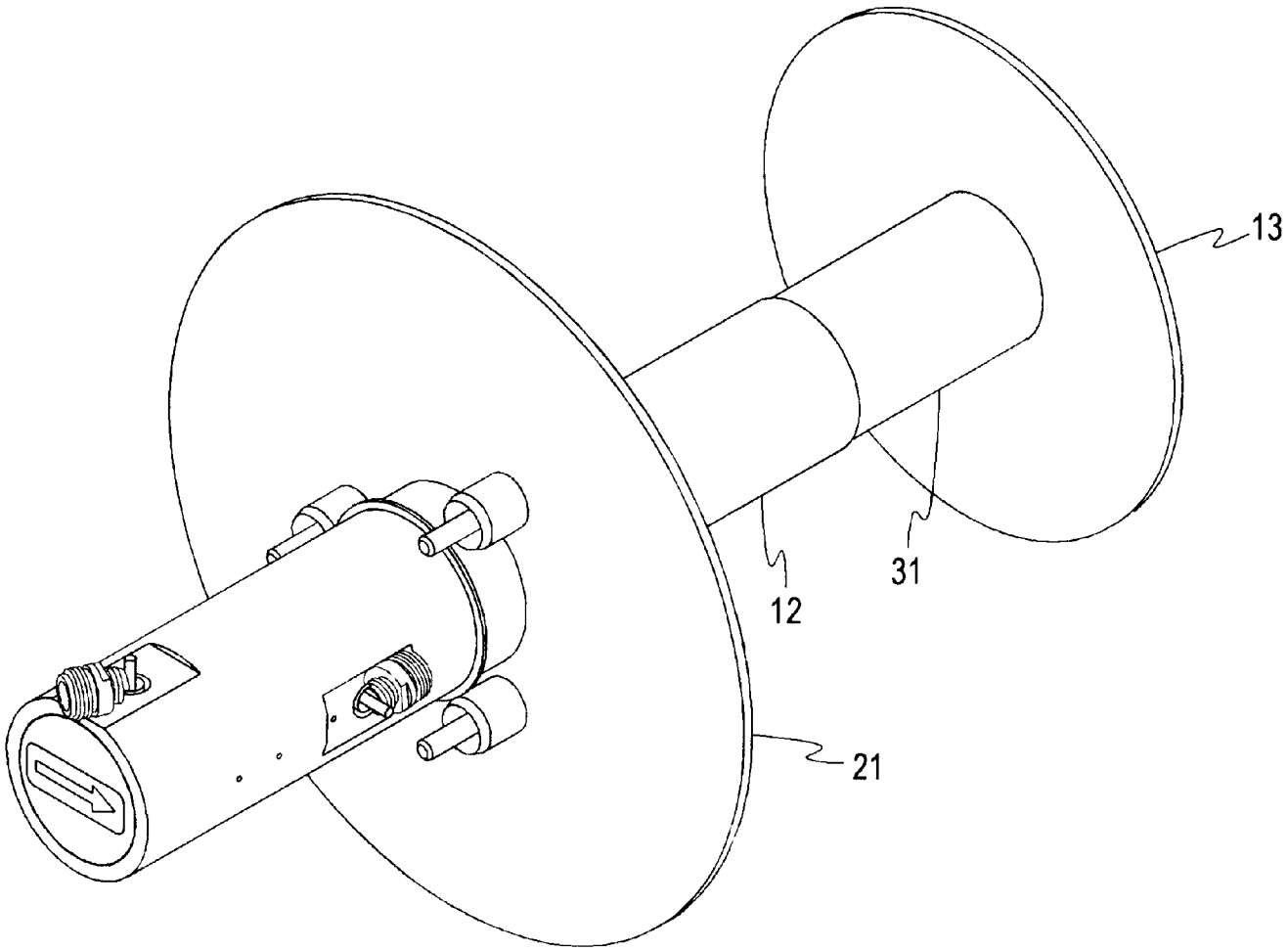
FIG. 4 is an enlarged and more detailed perspective view of the primary feed and subreflector subassembly in the antenna of FIGS. 1 and 2.
Figure 5:
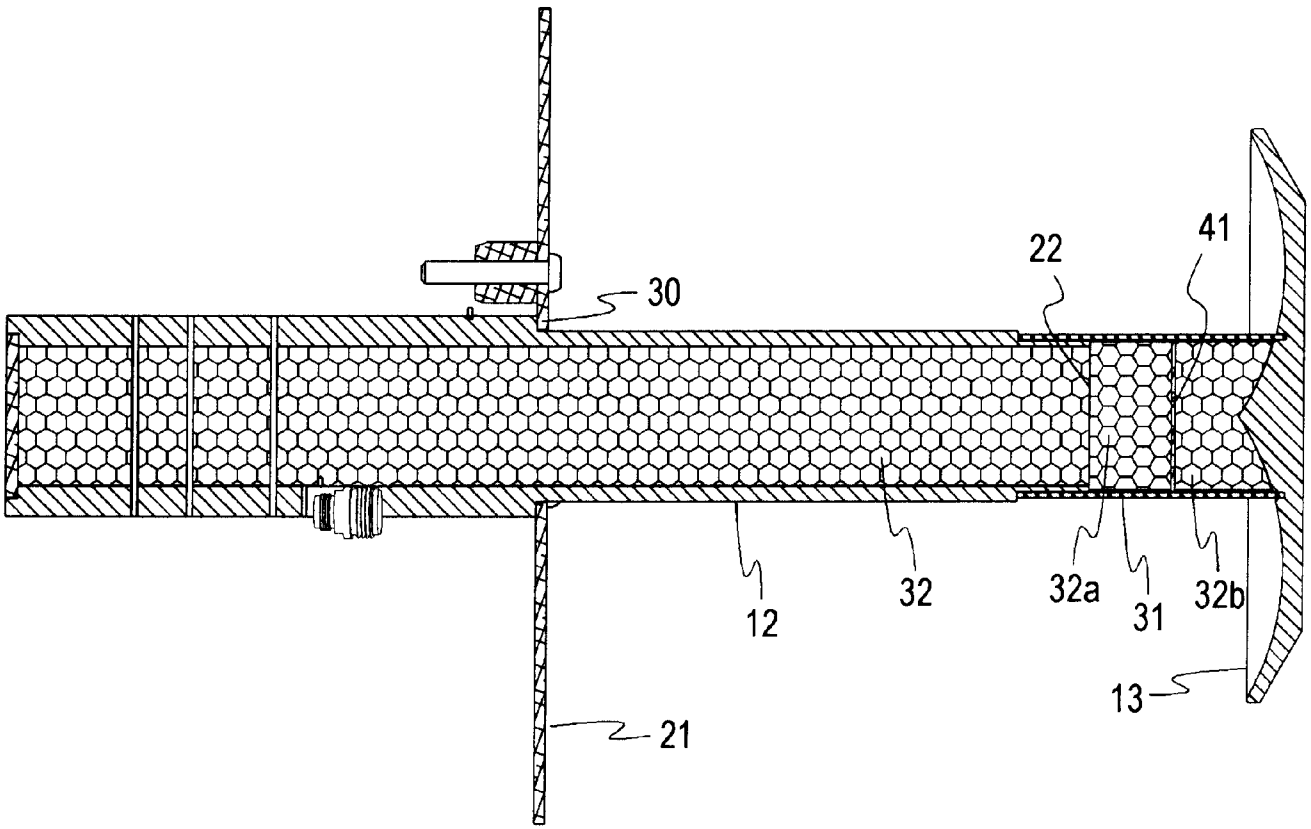
FIG. 5 is an enlarged longitudinal section of the subassembly of FIG. 4.
Figure 6:
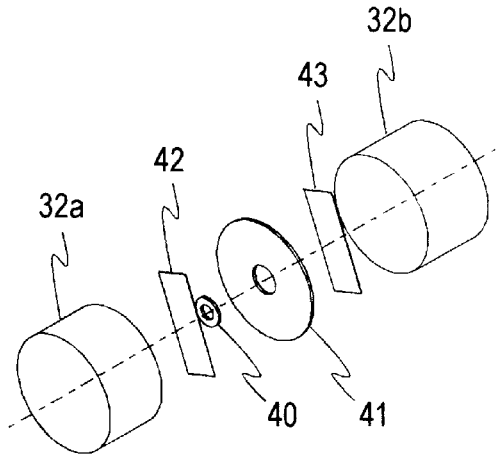
FIG. 6 is an exploded perspective of a portion of the subassembly of FIGS. 4 and 5.

The subassembly that contains both the primary feed and the subreflector is shown in more detail in FIGS. 4–6. As can be seen in FIG. 5, the outer surface of the circular waveguide 12 is machined to form a shoulder 30 that abuts the rear surface of the vertex plate 21 to accurately position the waveguide. A forward end portion of the waveguide is also machined to reduce its outside diameter for receiving a dielectric tube 31 attached to the central portion of the subreflector 13. The length of this dielectric tube 31 determines the position of the subreflector 13. The subreflector 13 is supported by bonding the dielectric tube 31 to both the reduced end portion of the waveguide 12 and the central portion of the subreflector 13.

The tube 31 is made of a dielectric material that is thin enough that the tube has a negligible effect on radiation that passes through the walls of the tube, e.g., radiation entering and exiting the waveguide 12 and radiation passing between the central portion of the subreflector 13 and the main reflector 10. It is preferred to also fill the waveguide 12 and the tube 31 with a closed-cell foam dielectric 32, having a similarly low dielectric constant, to protect the interior of the waveguide 12, and the transmission system to which it is connected, from moisture and other environmental conditions.

To reduce the return loss of the antenna due to reflection of energy back into the primary feed 12 from the subreflector 13, a dielectric or electrically conductive disc or annulus is positioned between the subreflector and the end of the primary feed. In the antenna of FIGS. 2–6, a small metal annulus 40 (see FIG. 6) is mounted within the dielectric foam 32 filling the dielectric tube 31. The diameter and thickness of the annulus 40 are selected to produce a reflection having a magnitude that cancels subreflector reflections back toward the open end of the circular waveguide 12, and the position of the annulus 40 along the axis 11 produces the phase difference required for the desired cancellation. To hold the metal annulus 40 in the desired position, the annulus is captured in a central aperture in a dielectric disc 41, which in turn is sandwiched between two cylindrical segments 32*a* and 32*b* of the foam dielectric 32. Two adhesive strips 42 and 43 bond opposite surfaces of the disc 41 to the opposed faces of the two dielectric segments 32*a* and 32*b*, as shown most clearly in FIG. 6.

Figure 7:
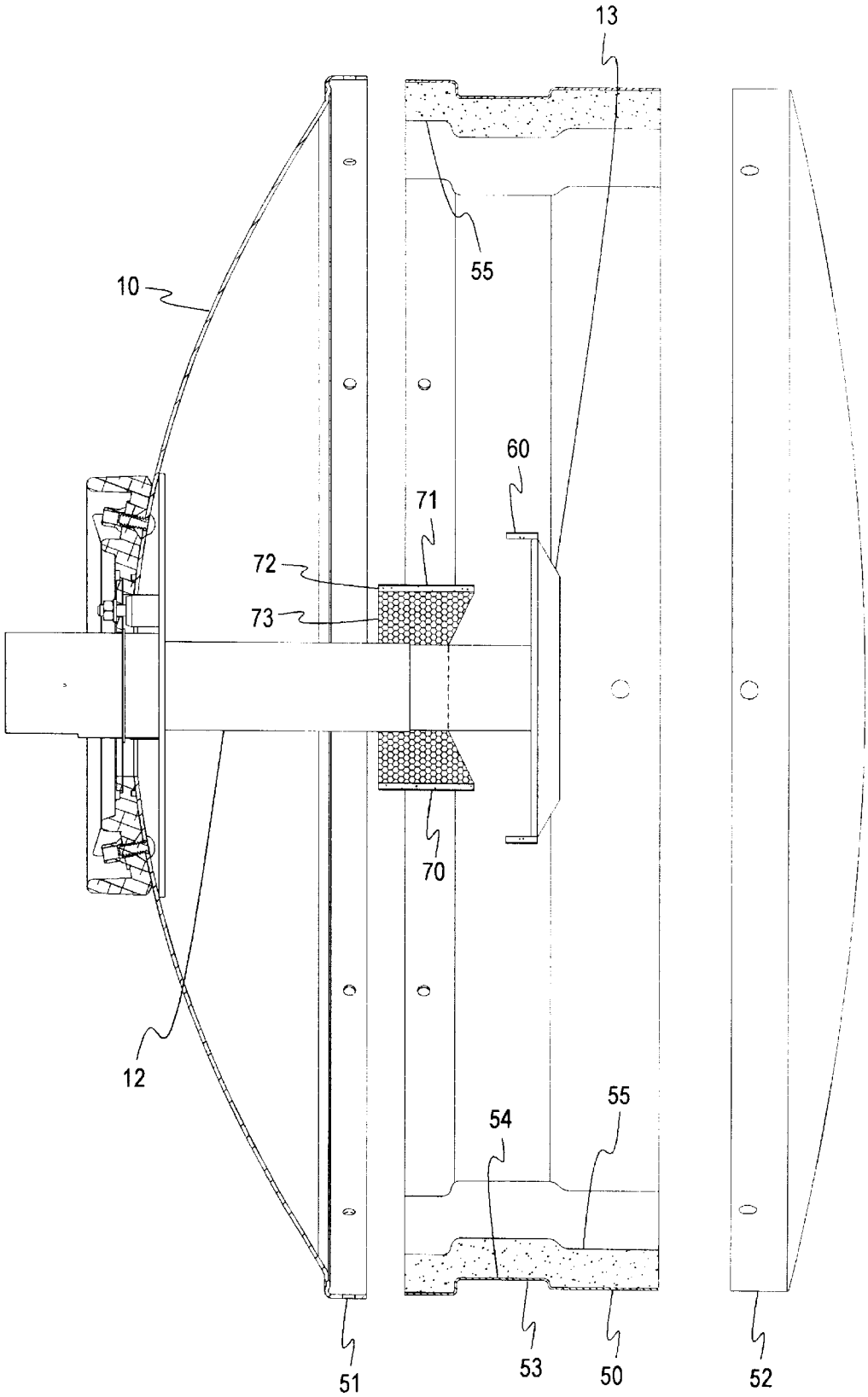
FIG. 7 is an exploded top plan view, partially in section, of a modified dual-reflector antenna embodying additional aspects of the present invention.

FIG. 7 illustrates a modified antenna in which components common to those in FIGS. 1–6 have been identified by the same reference numbers. In this antenna, a cylindrical metal shield 50 extends around the outer periphery of the main reflector 10 and projects from the main reflector in the same direction as the energy being transmitted by the main reflector 10 from the subreflector 13. One end of the shield 50 telescopes over, and is attached to, a peripheral flange 51 on the reflector 10, and the other end of the shield 50 receives a radome 52.

To reduce the return loss of the shield 50, the shield is provided with a band of dielectric or electrically conductive material extending around the inner surface of the shield. In the illustrative embodiment of FIG. 7, this band is formed by deforming inwardly a short section 53 of the shield 50 to form an inwardly raised band 54 that extends 360° around the inside surface of the shield. The band 54 is positioned to surround the open end of the circular waveguide 12, and is dimensioned to cancel reflections from the shield back toward the primary feed.

In addition, pads 55 of absorber material are attached to the inner surface of the shield 50 to improve the horizontal pattern of the antenna. To minimize the reduction in gain due to use of the absorber, the pads 55 are preferably applied to only opposite side portions of the shield 50, covering subtended angles of about 30° at each of the diametrically opposed locations. The use of absorber only in these limited regions also reduces the cost of the antenna. If gain loss and cost are not major concerns, then the absorber lining may extend around the entire circumference of the shield.

To further improve the patterns, an absorber-lined cylindrical metal shield 60 extends around the outer periphery of the subreflector 13 and projects from the subreflector toward the main reflector 10. The shield 60 extends from the outer periphery of the subreflector 13 through a portion of the distance to the ring focus RF, so that it does not intercept a ray line between the outer periphery of the main reflector 10 and the center of the subreflector 13.

For still further improvements in the antenna patterns, an absorber-lined shield 70 surrounds the end portion of the circular waveguide 12. This shield 70 includes a metal outer layer 71, a layer 72 of absorber material on the inside surface of the metal layer 71, and an annular support member 73 made of rigid foam dielectric bonded to the outer surfaces of the waveguide 12 and the dielectric tube. This feed system shield is particularly useful with the subreflector having a ring focus because there is sufficient space between the primary feed and the radius of the innermost ray path between the main reflector and the subreflector to accommodate such a shield. However, the feed system shield also can be used in prime-focus antennas using feed horns that produce a radiation level in the 90° region that is sufficiently high to effect a marked degradation of the total antenna radiation pattern.

Figure 8:
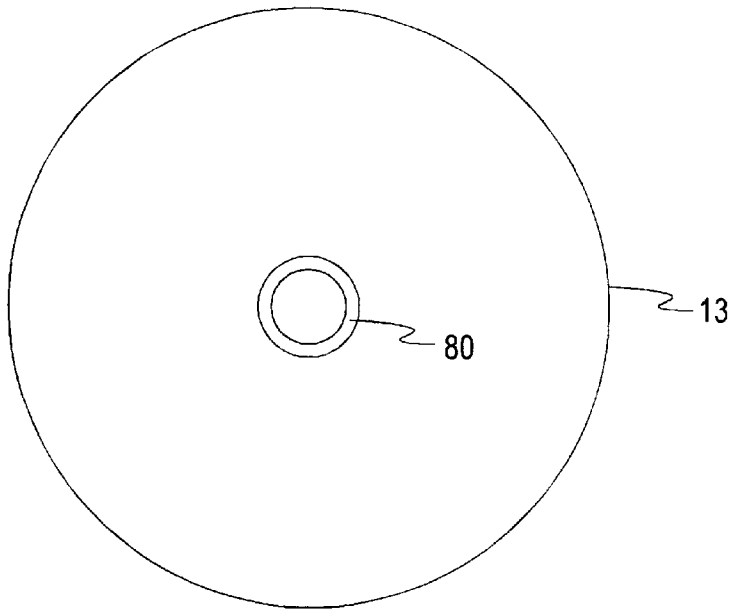
FIG. 8 is a front elevation of a modified subreflector embodying a further aspect of the present invention.

FIG. 8 illustrates yet another feature for reducing the return loss from the subreflector 13. Here an annulus 80 of absorber material is applied directly to the reflecting surface of the subreflector. The annulus is dimensioned such that the contribution to the total VSWR of the area of the subreflector surface not covered by the annulus 80 is close to zero. In the illustrative embodiment, the annulus 80 may have a width of about ⅛ inch for a subreflector having a diameter of about six inches. An annulus of this size does not significantly change the illumination of the subreflector, and the proportion of the total feed energy that is manipulated is substantially reduced, thereby reducing radiation pattern degradation.

It has been found that the use of the ring-focus subreflector with a conventional paraboloidal main reflector having a single axis of revolution, provides significantly better gain than other dual-reflector antennas having main-reflector diameters in the range from about 10 to about 20 wavelengths or smaller, with little or no increase in the cost of the antenna.

What is claimed is:

1. A dual-reflector microwave antenna comprising a main reflector having a shape that is a portion of a paraboloid generated by revolution of a parabola around having a single, common axis of rotation and symmetry, a primary feed extending along said axis on the concave side of the main reflector and having an aperture spaced away from said main reflector, and a subreflector located beyond the end of said primary feed for reflecting radiation from the main reflector into the primary feed and for reflecting radiation from the primary feed onto the main reflector, said subreflector having an image-inverting surface configuration that has a ring focus located between the main reflector and the subreflector and extending around said axis of revolution of said paraboloid, said ring focus having a diameter at least as large as the diameter of the aperture of said primary feed.

2. The dual-reflector antenna of claim 1 wherein said subreflector has a shape that is a portion of an ellipsoid generated by revolution of an ellipse around said axis of rotation of said paraboloid, a first focal point of said ellipse being located on said axis of revolution and a second focal point of said ellipse being offset from said axis of revolution so that revolution of said ellipse around said axis forms a focal ring extending around said axis of revolution.

3. The dual-reflector antenna of claim 2 wherein said first focal point of said ellipse and the end of said primary feed are located at the phase center of said primary feed.

4. The dual-reflector antenna of claim 2 wherein said second focal point of said ellipse is located at least as far from said axis of revolution as the outer edge of the aperture of said primary feed.

5. The dual-reflector antenna of claim 1 wherein the focus of said main reflector is located on the opposite side of said subreflector from said primary feed.

6. The dual-reflector antenna of claim 1 wherein the outer periphery of said main reflector lies in a plane that is orthogonal to said axis of revolution and that extends through said primary feed.

7. The dual-reflector antenna of claim 1 wherein said main reflector and said subreflector are both generally circular and symmetrical around said axis of revolution.

8. The dual-reflector antenna of claim 1 wherein said primary feed is a circular waveguide.

9. The dual-reflector antenna of claim 1 which includes a shield extending around the outer periphery of said main reflector and projecting from said main reflector in the same direction as the energy being transmitted by said main reflector from said subreflector.

10. The dual-reflector antenna of claim 9 which includes an absorber lining on the inner surface of said shield extending around the outer periphery of said main reflector.

11. The dual-reflector antenna of claim 10 wherein said absorber material is only on the side portions of the inner surface of said shield.

12. The dual-reflector antenna of claim 9 which includes a band of dielectric material extending around at least a portion of the inner surface of said shield for reducing the return loss of the antenna.

13. The dual-reflector antenna of claim 9 which includes a band of electrically conductive material extending around at least a portion of the inner surface of said shield for reducing the return loss of the antenna.

14. The dual-reflector antenna of claim 1 which includes at least one shield at the outer periphery of said subreflector and projecting from said subreflector toward said main reflector.

15. The dual-reflector antenna of claim 14 which includes an absorber lining on the inner surface of said shield at the outer periphery of said subreflector.

16. The dual-reflector antenna of claim 1 which includes a shield of absorber material extending around the outer periphery of the end portion of said primary feed.

17. The dual-reflector antenna of claim 16 wherein said shield of absorber includes a cylindrical metal outer layer, a cylindrical layer of absorber on the inside surface of said metal layer, and a cylindrical foam dielectric supporting said absorber layer on the outer surface of said primary feed.

18. The dual-reflector antenna of claim 17 wherein the diameter of the outer surface of said outer metal layer is smaller than the diameter of said subreflector.

19. The dual-reflector antenna of claim 1 which includes a dielectric or electrically conductive element between said primary feed and said subreflector for reducing the return loss of the antenna.

20. The dual-reflector antenna of claim 1 in which said main reflector has an outside diameter in the range from about 10 to about 20 wavelengths or smaller at the center frequency of the microwave signals being transmitted or received.

21. The dual-reflector antenna of claim 1 which includes an annulus of absorber material on the surface of said subreflector for reducing the return loss of the antenna.

22. A dual reflector microwave antenna comprising a main reflector having a shape that is a portion of at least one paraboloid and having an axis of symmetry, a primary feed extending along said axis and having an aperture spaced away from said main reflector, a subreflector located beyond the end of said primary feed for reflecting energy from said primary feed onto said main reflector, and for reflecting energy from said main reflector into said primary feed, and a dielectric or electrically conductive non-supporting disc between said primary feed and said subreflector for reducing the return loss of the antenna.

23. The dual-reflector antenna of claim 22 wherein said subreflector has a shape that is a portion of an ellipsoid generated by revolution of an ellipse around said axis of rotation of said paraboloid, a first focal point of said ellipse being located on said axis of revolution and a second focal point of said ellipse being offset from said axis of revolution so that revolution of said ellipse around said axis forms a focal ring extending around said axis of revolution.

24. The dual-reflector antenna of claim 23 wherein said first focal point of said ellipse and the end of said primary feed are located at the phase center of said primary feed.

25. The dual-reflector antenna of claim 23 wherein said second focal point of said ellipse is located at least as far from said axis of revolution as the outer edge of the aperture of said primary feed.

26. The dual-reflector antenna of claim 22 wherein the focus of said main reflector is located on the opposite side of said subreflector from said primary feed.

27. The dual-reflector antenna of claim 22 wherein the outer periphery of said main reflector lies in a plane that is orthogonal to said axis of revolution and that extends through said primary feed.

28. The dual-reflector antenna of claim 22 wherein said main reflector and said subreflector are both generally circular and symmetrical around said axis of revolution.

29. The dual-reflector antenna of claim 22 wherein said primary feed is a circular waveguide.

30. The dual-reflector antenna of claim 22 which includes a shield extending around the outer periphery of said main reflector and projecting from said main reflector in the same direction as the energy being transmitted by said main reflector from said subreflector.

31. The dual-reflector antenna of claim 30 which includes an absorber lining on the inner surface of said shield extending around the outer periphery of said main reflector.

32. The dual-reflector antenna of claim 31 wherein said absorber material is only on the side portions of the inner surface of said shield.

33. The dual-reflector antenna of claim 30 which includes a band of dielectric material extending around at least a portion of the inner surface of said shield for reducing the return loss of the antenna.

34. The dual-reflector antenna of claim 30 which includes a band of electrically conductive material extending around at least a portion of the inner surface of said shield for reducing the return loss of the antenna.

35. The dual-reflector antenna of claim 22 which includes at least one shield at the outer periphery of said subreflector and projecting from said subreflector toward said main reflector.

36. The dual-reflector antenna of claim 35 which includes an absorber lining on the inner surface of said shield at the outer periphery of said subreflector.

37. The dual-reflector antenna of claim 22 which includes a shield of absorber material extending around the outer periphery of the end portion of said primary feed.

38. The dual-reflector antenna of claim 37 wherein said shield of absorber includes a cylindrical metal outer layer, a cylindrical layer of absorber on the inside surface of said metal layer, and means for supporting said absorber layer around said primary feed.

39. The dual-reflector antenna of claim 38 wherein the diameter of the outer surface of said outer metal layer is smaller than the diameter of said subreflector.

40. A dual reflector microwave antenna comprising a main reflector having a shape that is a portion of at least one paraboloid and having an axis of symmetry, a primary feed extending along said axis and having an aperture spaced away from said main reflector, a subreflector located beyond the end of said primary feed for reflecting energy from said primary feed onto said main reflector, and for reflecting energy from said main reflector into said primary feed, and an annulus of absorber material on the surface of said subreflector for reducing the return loss of the antenna.

41. The dual-reflector antenna of claim 40 wherein said subreflector has a shape that is a portion of an ellipsoid generated by revolution of an ellipse around said axis of rotation of said paraboloid, a first focal point of said ellipse being located on said axis of revolution and a second focal point of said ellipse being offset from said axis of revolution so that revolution of said ellipse around said axis forms a focal ring extending around said axis of revolution.

42. The dual-reflector antenna of claim 41 wherein said first focal point of said ellipse and the end of said primary feed are located at the phase center of said primary feed.

43. The dual-reflector antenna of claim 41 wherein said second focal point of said ellipse is located at least as far from said axis of revolution as the outer edge of the aperture of said primary feed.

44. The dual-reflector antenna of claim 40 wherein the focus of said main reflector is located on the opposite side of said subreflector from said primary feed.

45. The dual-reflector antenna of claim 40 wherein the outer periphery of said main reflector lies in a plane that is orthogonal to said axis of revolution and that extends through said primary feed.

46. The dual-reflector antenna of claim 40 wherein said main reflector and said subreflector are both generally circular and symmetrical around said axis of revolution.

47. The dual-reflector antenna of claim 40 wherein said primary feed is a circular waveguide.

48. The dual-reflector antenna of claim 40 which includes a shield extending around the outer periphery of said main reflector and projecting from said main reflector in the same direction as the energy being transmitted by said main reflector from said subreflector.

49. The dual-reflector antenna of claim 48 which includes an absorber lining on the inner surface of said shield extending around the outer periphery of said main reflector.

50. The dual-reflector antenna of claim 49 wherein said absorber material is only on the side portions of the inner surface of said shield.

51. The dual-reflector antenna of claim 48 which includes a band of dielectric material extending around at least a portion of the inner surface of said shield for reducing the return loss of the antenna.

52. The dual-reflector antenna of claim 48 which includes a band of electrically conductive material extending around at least a portion of the inner surface of said shield for reducing the return loss of the antenna.

53. The dual-reflector antenna of claim 40 which includes at least one shield at the outer periphery of said subreflector and projecting from said subreflector toward said main reflector.

54. The dual-reflector antenna of claim 53 which includes an absorber lining on the inner surface of said shield at the outer periphery of said subreflector.

55. The dual-reflector antenna of claim 40 which includes a shield of absorber material extending around the outer periphery of the end portion of said primary feed.

56. The dual-reflector antenna of claim 55 wherein said shield of absorber includes a cylindrical metal outer layer, a cylindrical layer of absorber on the inside surface of said metal layer, and a cylindrical foam dielectric supporting said absorber layer on the outer surface of said primary feed.

57. The dual-reflector antenna of claim 56 wherein the diameter of the outer surface of said outer metal layer is smaller than the diameter of said subreflector.

58. The dual-reflector antenna of claim 40 which includes a dielectric or electrically conductive element between said primary feed and said subreflector for reducing the return loss of the antenna.

59. A reflector-type microwave antenna comprising a reflector having a shape that is a portion of at least one paraboloid and having an axis of symmetry, a primary feed for transmitting microwave energy to and from said main reflector and having an aperture spaced away from said main reflector, and a shield of absorber material extending around the outer periphery of at least the end portion of said primary feed.

60. The dual-reflector antenna of claim 59 wherein said shield of absorber material includes a cylindrical metal outer layer, a cylindrical layer of absorber material on the inside surface of said metal layer, and a cylindrical foam dielectric supporting said absorber layer on the outer surface of said primary feed.

61. A reflector-type microwave antenna comprising a main reflector having a shape that is a portion of at least one paraboloid and having an axis of symmetry, a primary feed for transmitting microwave energy to and from said main reflector and having an aperture spaced away from said main reflector, and a shield extending around the outer periphery of said reflector and projecting from said reflector in the same direction as the energy being transmitted by said reflector from said primary feed, and a band of dielectric or electrically conductive material extending around at least a portion of the inner surface of said shield for reducing the return loss of the antenna.

62. A dual reflector microwave antenna comprising a main reflector having a shape that is a portion of at least one paraboloid and having an axis of symmetry, a primary feed for transmitting microwave energy to and from said main reflector and having an aperture spaced away from said main reflector, a subreflector located beyond the end of said primary feed for reflecting energy from said primary feed onto said main reflector, and for reflecting energy from said main reflector into said primary feed, said subreflector having an image-inverting surface configuration that has a ring focus located between the main reflector and the subreflector and extending around said axis of revolution of said paraboloid, said ring focus having a diameter at least as large as the diameter of the aperture of said primary feed, and a shield extending around the outer periphery of said main reflector and projecting from said main reflector in the same direction as the energy being transmitted by said main reflector from said subreflector, and pads of absorber material on the inner surface of said shield for improving the horizontal pattern of the antenna.

63. A method of transmitting microwave signals, said method comprising providing a main reflector having a shape that is a portion of a paraboloid generated by revolution of a parabola around having a single, common axis of rotation and symmetry, transmitting microwave signals through a primary feed extending along said axis on the concave side of the main reflector and having an aperture spaced away from said main reflector, said microwave signals being launched through said aperture, and reflecting said microwave signals launched through said aperture from a subreflector located beyond the end of said primary feed onto said main reflector, said subreflector having an image-inverting surface configuration that has a ring focus located between the main reflector and the subreflector and extending around said axis of revolution of said paraboloid, said ring focus having a diameter at least as large as the diameter of the aperture of said primary feed.

* * * * *